US005255549A

United States Patent [19]

Williams

[11] Patent Number: 5,255,549

[45] Date of Patent: Oct. 26, 1993

[54] TENSION LEVELER ROLL CLEANING SYSTEM AND METHOD

[75] Inventor: Robert A. Williams, Bath, Ohio

[73] Assignee: The Monarch Machine Tool Company, New Bremen, Ohio

[21] Appl. No.: 896,220

[22] Filed: Jun. 10, 1992

[51] Int. Cl.[5] ..... B21B 45/02; B21D 1/02

[52] U.S. Cl. ..... 72/40; 72/160; 72/236; 15/256.51

[58] Field of Search ..... 72/39, 40, 236, 160; 15/256.51

[56] References Cited

U.S. PATENT DOCUMENTS

| | | | |
|---|---|---|---|
| 2,107,541 | 2/1938 | Long . | |
| 2,352,040 | 6/1944 | Ungerer | 15/256.51 |
| 2,949,147 | 8/1960 | Maust | 15/256.51 |
| 2,953,952 | 9/1960 | Alexander . | |
| 3,379,044 | 4/1968 | Kirschner . | |
| 3,604,239 | 9/1971 | Moxon | 72/236 |
| 4,344,361 | 8/1982 | MacPhee | 15/256.51 |
| 4,852,209 | 8/1989 | Svenka et al. . | |
| 4,953,252 | 9/1990 | Akisawa . | |
| 4,998,428 | 3/1991 | Rechenbach | 72/40 |
| 5,081,857 | 1/1992 | Matsui et al. | 72/236 |

FOREIGN PATENT DOCUMENTS

| | | | |
|---|---|---|---|
| 1242487 | 6/1967 | Fed. Rep. of Germany | 72/236 |
| 296978 | 12/1987 | Japan | 72/39 |
| 199022 | 8/1988 | Japan | 72/40 |
| 237026 | 9/1989 | Japan | 72/39 |
| 11329 | 1/1990 | Japan | 15/256.51 |
| 41705 | 2/1990 | Japan | 72/39 |
| 248717 | 11/1991 | Japan | 72/39 |

*Primary Examiner*—Daniel C. Crane

*Attorney, Agent, or Firm*—Thompson, Hine and Flory

[57] ABSTRACT

A tension leveler roll cleaning system which is incorporated in a tension leveler of a type having a work roll supported by backup rolls and includes a payout stand, a takeup stand, and a strip of fabric media which is guided about the backup rolls. The payout stand preferably is positioned upstream of the backup rolls and the takeup stand downstream of the backup rolls. The strip of fabric media extends between the payout stand and takeup stand, and is held against arcuate portions of the backup rolls by spacer plates which extend between the bearing plates supporting the work and backup rolls. The takeup stand includes a hydraulic motor which is actuated to recoil the strip material and draw it from the payout stand about the backup rolls. The strip material is mounted in coiled form on the payout stand and is recoiled into a coil for efficient disposal. In a preferred embodiment, the system includes a solvent delivery component which consists of a spray manifold, supplied by a source of solvent under pressure for depositing solvent on the media. Preferred solvents are kerosene, petroleum hydrocarbon and petroleum naphtha.

29 Claims, 4 Drawing Sheets

TENSION LEVELER ROLL CLEANING SYSTEM AND METHOD

BACKGROUND OF THE INVENTION

The present invention relates to roll cleaning systems for metal working machinery and, more particularly, to systems for cleaning the work and backup rolls of tension levelers.

In a tension leveling operation, strip metal is cold worked by passing it about small radius rolls positioned to provide up and down bends with the strip under tension, which results in uniform elongation of strip fibers beyond the yield point of the metal. The result of this uniform elongation is to provide a consistent plastic deformation across the entire width of the strip. This introduces a homogenous stress pattern that avoids problems of distortion of the strip inherent in the rolling process which result from variations in thickness of the strip across its width.

In order to provide sufficient elongation in a relatively short run, it is desirable to minimize the diameter of the work rolls around which the sheet material is passed under tension, which results in greater elongation per pass. Due to the stresses involved, it is necessary to support such small-diameter work rolls on larger diameter backup rolls in order to prevent deflection of the work roll. A problem inherent in tension leveling processes is that the work and backup rolls pick up contaminants which collect on these rolls and may adversely affect the desired quality and speed of the leveling process.

This problem is especially pronounced when strip aluminum is tension leveled. Strip aluminum contains particles of aluminum oxide which are extremely hard and abrasive. Such particles tend to collect on the work and backup rolls and cause brinelling of the backup roll, vibrations of the sheet, and a degradation in the quality of the leveled strip aluminum.

Efforts have been made in other areas to remove particulates accumulated on work rolls. For example, Kirschner U.S. Pat. No. 3,379,044 discloses a rolling mill in which the work rolls contact rotary brushes and scrapers, purportedly to remove collected particles. However, a potential disadvantage with such systems is that the particles removed are not contained; rather, they are merely removed from the work roll and held briefly, if at all, on the rotary brush, which may drop them in the surrounding area. This debris may create a hazard and increase the cost of operation due to frequent clean up activity.

Accordingly, there is a need for a roll cleaning system which affectively removes contaminants from work rolls and backup rolls of tension levelers and retains the removed material for efficient disposal.

SUMMARY OF THE INVENTION

The present invention is a tension leveler roll cleaning system and method which maintains the work and backup rolls of a tension leveler free from accumulated particulate contaminants, especially aluminum oxide particles which are collected during the leveling of strip aluminum. The system includes a strip of fabric media which is conveyed past the backup rolls on a side opposite the work roll. The rate of travel of the fabric is less than the rate of the peripheral speed of the backup rolls so that there exists relative movement between the strip and rolls. This contact is sufficient to remove substantially all of the accumulated debris from the backup rolls. Since the backup rolls remove accumulated particulate contaminants from the work roll, the system acts to maintain the work roll free of collected contaminants as well.

In a preferred embodiment, the system includes a payout stand, which supports a coiled roll of unused fabric material and a takeup roll support, which includes a hydraulic motor for recoiling the strip once it has been conveyed passed the backup rolls and has collected particulates from them. Also in the preferred embodiment, the tension leveler includes multiple work roll stations and the payout stand includes a corresponding number of rolls of fabric media, each unrolled and conveyed past a particular set of backup rolls.

Also in the preferred embodiment, the system includes a solvent delivery system. The solvent system includes multi-orificed spray headers which extend across the width of the fabric material at positions upstream and downstream of the backup rolls, a source of solvent under pressure, and a conduit for conveying the solvent to the header. The solvent is deposited on the fabric media to wet it and facilitate the transfer of accumulated particulate contaminants from the backup rolls to the fabric material. The wetting of fabric is preferable to the wetting of the backup rolls themselves since less solvent is collected on the backup rolls and transferred to the work roll.

Also in the preferred embodiment, the backup rolls and work roll are supported between a bearing supports which are separated by three spacer plates. The spacer plates are sized and positioned to support the strip of fabric material and urge it against arcuate portions of the backup rolls.

Accordingly, it is an object of the present invention to provide a method and system for cleaning the backup and work rolls and hence the work roll of a tension leveler; a method and system to reduce the strip chatter and produce a better quality leveled product; a method and system for cleaning the backup and work rolls which minimizes the formation of hazardous material; a method and system for cleaning the backup and work rolls of a tension leveler which eliminates flakes from the previous cutting formation of the strip; a method and system for cleaning the backup and work rolls of a tension leveler which allows the line speed to be increased without a degradation in strip quality or excessive strip chatter; and a method and system for cleaning the work and backup rolls of a tension leveler which is relatively simple in construction, reliable and relatively easy to maintain.

Other objects and advantages of the present invention will be apparent from the following description, the accompanying drawings and the appended claims.

DETAILED DESCRIPTION

Figure 1:
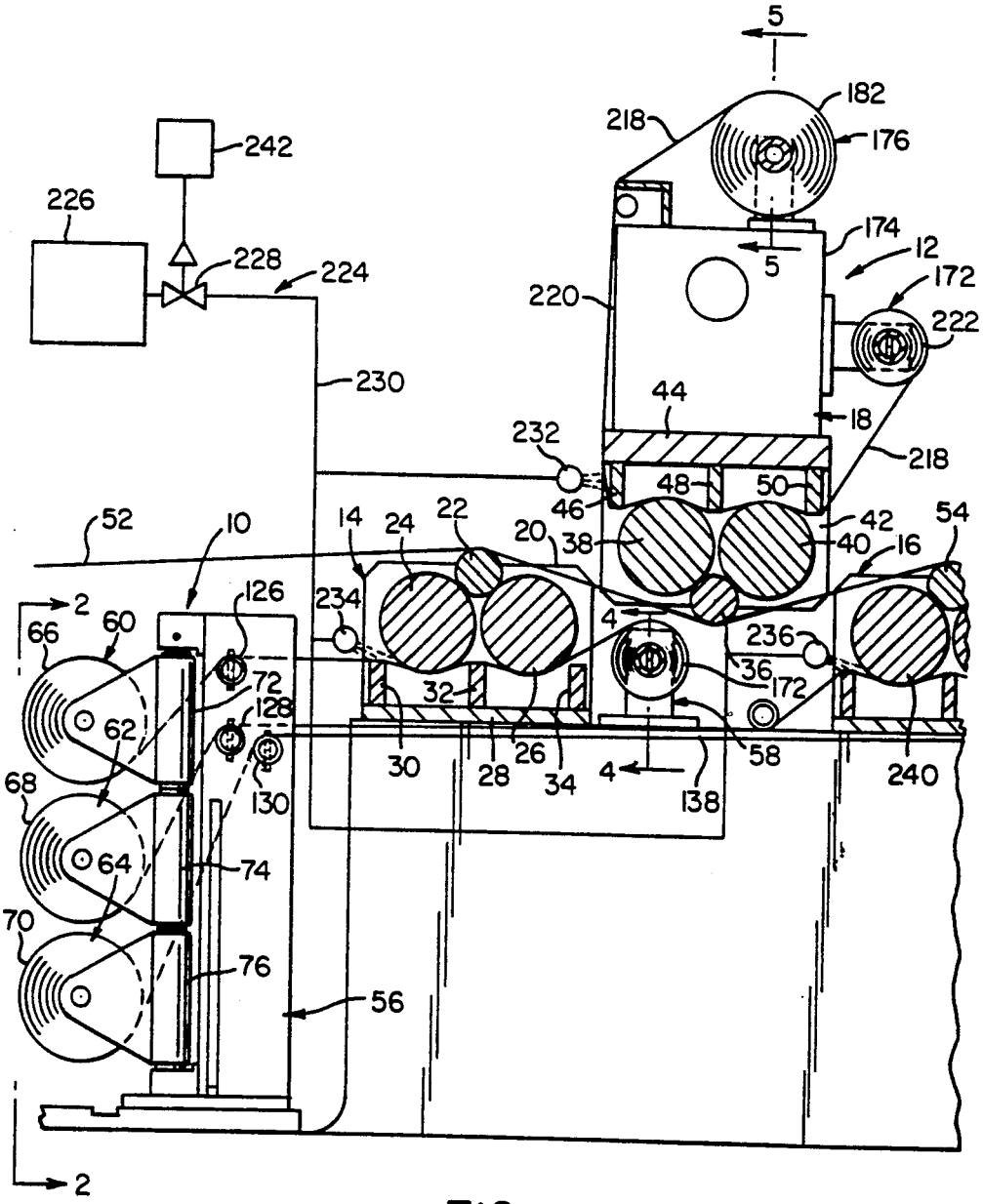
FIG. 1 is a schematic side elevation of the roll cleaning system of the preferred embodiment, shown with a typical tension leveler which is partly in section.

The tension leveler roll cleaning system, generally designated 10, is shown in FIG. 1 in combination with a tension leveler, generally designated 12. The tension leveler 12 includes lower work roll units 14, 16, and upper work roll unit 18. Work roll unit 14 includes bearing support plates 20, 21 (see FIG. 7) which support a cylindrical work roll 22 and a pair of backup rolls 24, 26. The bearing support plates 20, 21 are mounted on a base plate 28 and are separated and reinforced by spacer plates 30, 32, 34. Although not shown in its entirety in FIG. 1, work roll unit 16 is substantially identical construction to unit 14.

Upper work roll unit 18 includes a work roll 36 and backup rolls 38, 40, supported on a bearing plate 42 which is mounted on a base plate 44 and is separated from an opposing bearing plate (not shown) by spacer plates 46, 48, 50 in a manner similar to that of unit 14.

A strip of aluminum sheet 52 is uncoiled from an unwinder (not shown) and threaded through the leveler 12 such that it bends alternately downwardly and upwardly around work rolls 22, 36 and 54 of work roll units 14, 18 and 16. The strip 52 is then recoiled on a rewinder (not shown) in a manner known in the art. It is to be understood that the leveler 12 may have any desired number of upper and lower work roll units similar to the units 14, 16, 18, and not depart from the scope of the invention.

The cleaning system 10 includes a payout stand 56, a takeup stand 58, and strips of fabric media 60, 62, 64. A preferred material is a 100% polyester, 10-ply laminate, approximately 27 inches thick. Payout stand 56 and strips 60, 64 service the lower work roll units of the tension leveler 12. Specifically, strip 60 is associated with work roll unit 14, strip 62 is associated with work roll unit 16, and strip 64 is associated with a subsequent lower work roll unit which is not shown.

Strips 60, 62, 64 are contained in coils 66, 68, 70 which are supported on the payout stand 56 on support units 72, 74, 76, respectively. The support units 72–76 are of identical construction, and accordingly the construction of unit 72 will be discussed in detail, it being understood that this discussion applies to the structure of units 74 and 76 as well.

Figure 3:
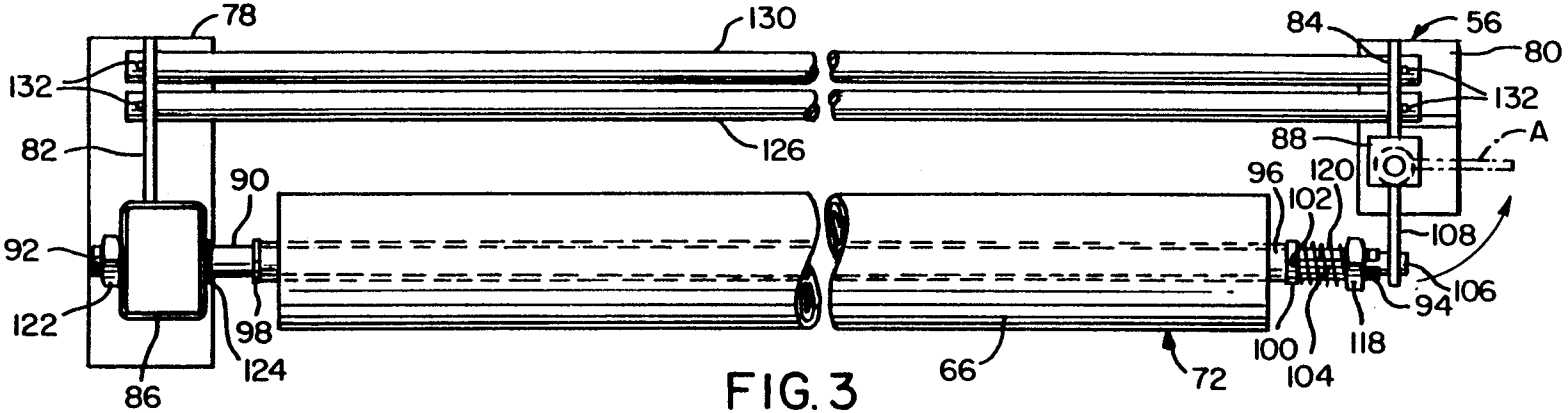
FIG. 3 is a top plan view taken at line 3—3 of FIG. 2.
Figure 2:
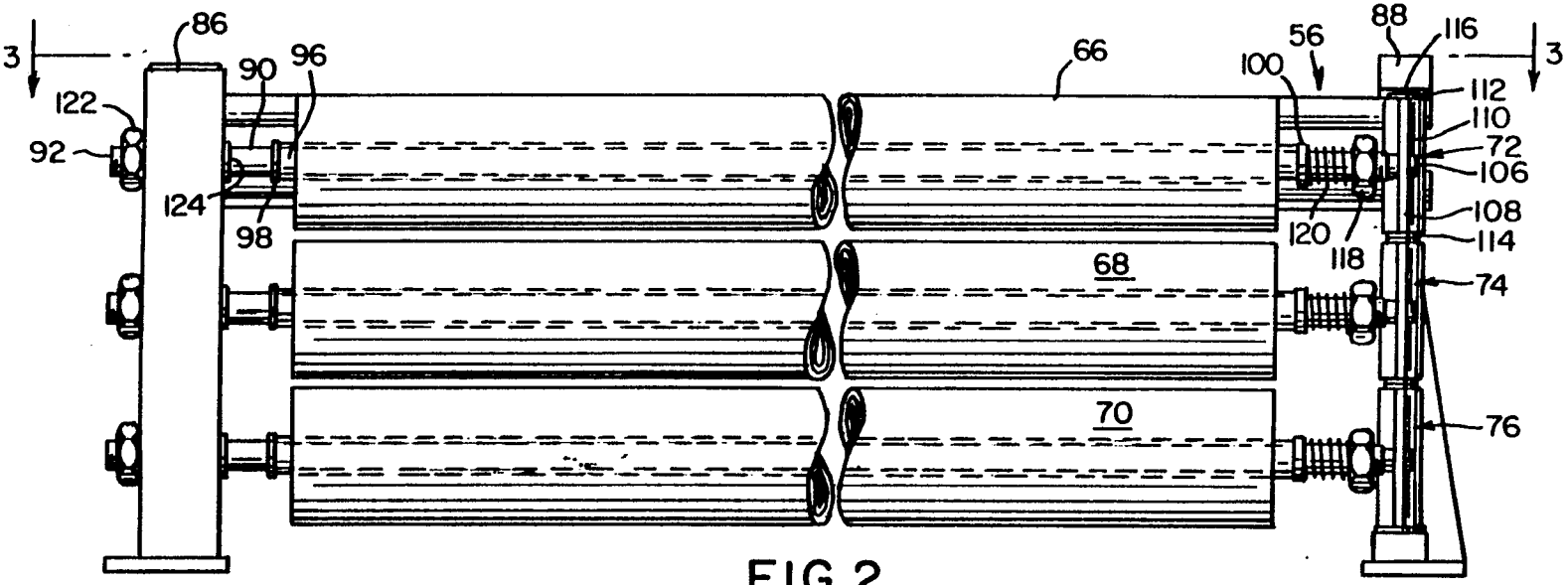
FIG. 2 is a front elevation taken at line 2—2 of FIG. 1.

As shown in FIGS. 2 and 3, support unit 72 is incorporated into the payout stand 56 which includes base plates 78, 80, parallel roll support plates 82, 84 and support posts 86, 88. The support unit 72 includes a central, hollow rod 90 which is threaded at its ends 92, 94 and supports a cardboard sleeve 96 which typically is included with the coil 66 of media. The sleeve 96 is captured between a fixed ring 98 and a slidable ring 100, both mounted on the rod 90. Ring 100 includes a cylindrical key 102 which slides in a key slot 104 formed in the end 94 of the rod 90, thereby preventing rotation of the ring relative to the rod. A stub 106 is pressed into the end of the rod 90 and is received within a gusset 108 which includes a sleeve 110 having bushings 112, 114 which receive a vertical shaft 116 mounted in the support post 88.

The gusset 108 includes a spring-loaded ball (not shown) which engages a corresponding groove (not shown) formed in the stub 106 to maintain engagement between the stub and gusset during use.

The shaft 90 supports a hex nut 118 which compresses a spring 120 which bears against the slidable ring 100. The compression spring 120 urges the ring 100 against the sleeve 96 to prevent the free rotation of the sleeve on the rod 90, which prevents a too-rapid payout of the strip 60 from its associated coil 66 mounted on the sleeve.

At the opposite end of the shaft 90, a threaded end 92 is retained within the support post 86 by a hex nut 122. Proper positioning of the rod 90 is achieved by a fixed ring 124 which bears against the support post 86. Consequently, a new roll can be mounted on the sleeve 96 by pivoting the gusset 108 about shaft 116 to the position A shown in phantom in FIG. 3, which exposes the end 94 of the shaft 90. The hex nut 118, spring 120 and sliding ring 100 are then removed from the shaft 90 and a new roll can be slid onto the sleeve 96. Alternately, the sleeve 96 itself is removed and replaced with a new sleeve carrying a new roll of strip material.

As shown in FIG. 1, the payout stand 56 also includes strip supports 126, 128, 130 which support the strips 60, 62, 64, respectively. Supports 126–130 are hollow rods which are journaled into the support plates 82, 84 and retained by pins 132 as shown in FIG. 3.

Figure 4:
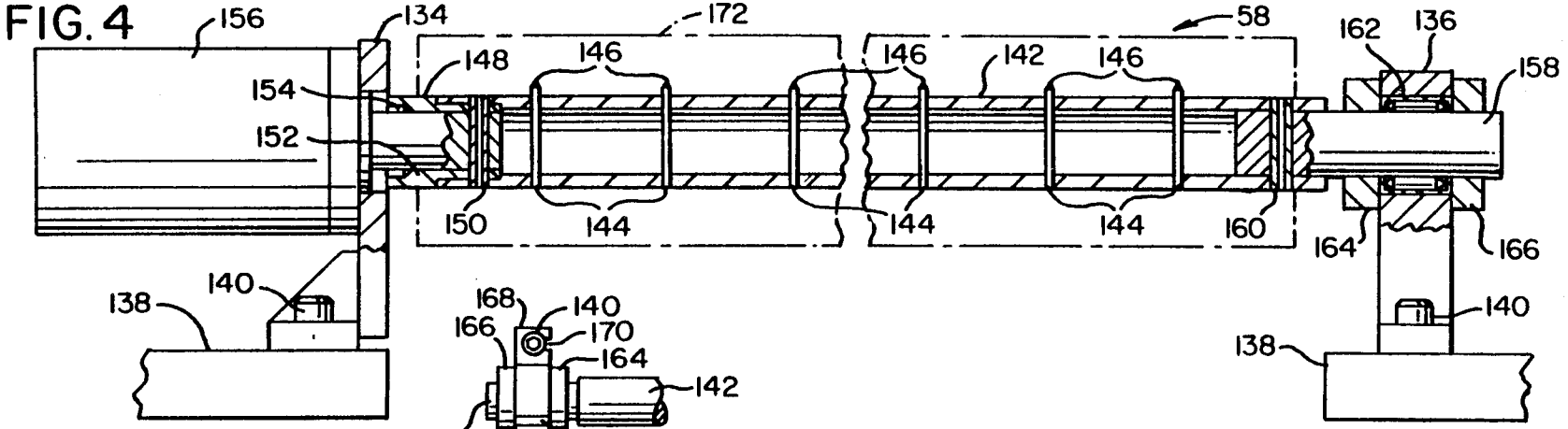
FIG. 4 is a cross-sectional view taken at line 4—4 of FIG. 1.

The takeup stand 58 is shown in FIGS. 1 and 4, and includes end plates 134, 136 which are attached to supporting structure 138 by machine screws 140. The stand 58 includes a hollow shaft 142 having a plurality of spikes 144 spaced along its length and pressed through it to expose pointed tips 146. Tips 146 catch and retain the leading edge of the media strip 60.

Adjacent plate 134, shaft 142 receives a cylindrical stub 148 which is retained by a pin 150. Stub 148 has an internal splined contour 152 which receives a mating, externally-splined shaft 154 of a hydraulic motor 156 which is mounted on plate 154. Adjacent plate 136, the shaft 142 receives a stub 158 which is retained by a pin 160. The stub 158 is received within a bearing 162 and is locked against the plate 136 by split rings 164, 166. Preferably, the bearing 162 is a Torrington-type DC roller clutch and bearing assembly, which prevents reverse rotation of the shaft 142.

Figure 5:
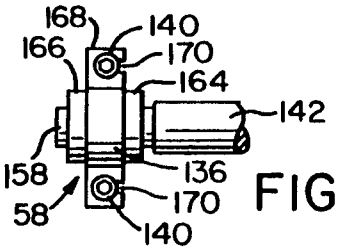
FIG. 5 is a detail of the take up support of FIG. 4.

As shown in FIG. 5, the takeup stand 58 includes a base plate 168 having cutouts 170 for receiving the screws 140. Consequently, when it is necessary to remove the rod 142 and dispose of the collected strip coil 172, the screws 140 are loosened and the support plate 136 slid sidewardly away from plate 134 until the stub 148 disengages the spline shaft 154 of the motor 156.

In operation, the strip of media 60 is unwound from coil 66, threaded over roller 126, then in between spacer plates 30, 32, 34 and work rolls 24, 26, then rewound on takeup stand 58 (see FIG. 1). Motor 156 is selectively actuated to rotates shaft 142 which causes the strip 60 to be unwound from the coil 66 and advanced passed the backup rolls 24, 26 at a predetermined rate. In the preferred embodiment, the motor 156 does not operate continuously, but is stepped to advance the strip 60 in incremental steps. Similarly, coils 68, 70 are unwound and their strips 62, 64 are threaded over rollers 128, 130 and to takeup stands (not shown) similar to takeup stand 58, but associated with different work roll units.

Figure 6:
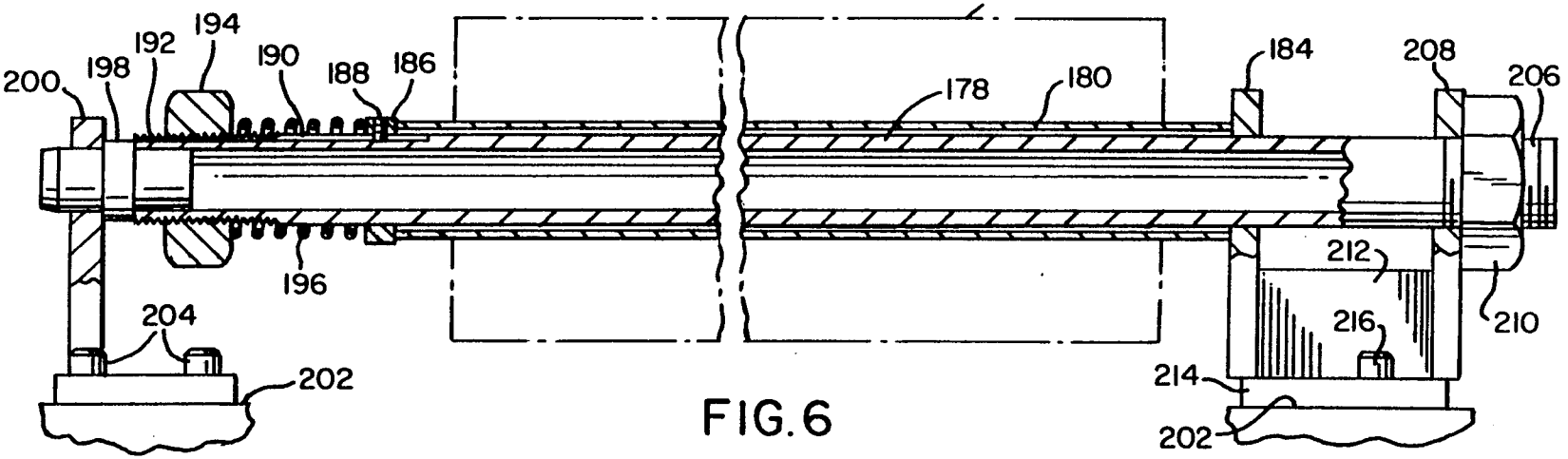
FIG. 6 is a cross-sectional view taken at line 5—5 of FIG. 1.

Upper work roll unit 18 includes a takeup stand 172 which is similar in construction to takeup stand 58 shown in FIGS. 4 and 5, except that it is mounted such that the support plates corresponding to support plates 134, 136 extend horizontally from the rear wall 174 of the unit 18. The payout stand, generally designated 176, is shown in FIG. 6 and includes a shaft 178 which supports a cardoard sleeve 180 having a coiled strip of material 182 supported on it and captured between a fixed bearing plate 184 and a slide ring 186 mounted on the shaft. The slide ring 186 includes a pin 188 which slides in a key slot 190. The end 192 of the shaft 178 is threaded and receives a hex nut 194 which compresses a coil spring 196 against the ring 186 to urge the sleeve 180 against the bearing plate 184. A stub 198 is pressed into the end 192 of the shaft 178 and is journaled into a support plate 200. Support plate 200 is mounted on the upper surface 202 of the upper work roll unit 18 and secured by screws 204. Opposite end 192 of shaft 178 is a threaded end 206 which is journaled through an outboard plate 208 and secured by a hex nut 210. Bearing plate 184 and outboard plate 208 are reinforced laterally by spacer plate 212, and the plates 184, 208, 212 are mounted on a base plate 214 which is mounted on the top surface 202 by screws 216.

As shown in FIG. 1, in operation a strip of media 218 is unwound from coil 182 and extends down over the front face 220 of the upper unit 18, and in between the spacer plates 46, 48, 50 and backup rolls 38, 40. The strip 218 then extends rearwardly and upwardly from plate 50 to be recoiled into a coil 222 on takeup stand 172. The friction engagement of the ring 186 against the sleeve 180 to prevent over-payout of media 218 is the same as for the support units 72, 74, 76. In order to replace rolls, the screws 204 are removed and the end plate 200 removed from the top surface 202 of the unit 18. This enables the nut 194, spring 196 and ring 186 to be removed, and the cardboard sleeve 180 slid off of the shaft 178.

Also as shown in FIG. 1, the preferred embodiment includes a solvent delivery system, generally designated 224. The system 224 includes a source of solvent 226 under pressure, a control valve 228 and supply line 230. A preferred solvent is kerosene; however, solvents such as petroleum hydrocarbon and petroleum naphtha may be used.

The latter two compounds can be purchased as KENSOL 50T and KENSOL 51 (KENSOL 50T and KENSOL 51 are trademarks of Whitco Corporation, New York, N.Y.).

The conduit 230 terminates in spray headers 232, 234, 236 which are positioned immediately upstream of the backup roll 38 of work roll unit 18, backup roll 24 of work roll unit 14 and backup roll 240 of work roll unit 216. The spray headers 232–236 are elongate sections of tubing which are perforated along their lengths to provide spray orifices across the entire width of the strips of fabric media 60, 62, 64, 68.

The valve 228 is actuated by a control 242 which controls the flow rate of solvent from the source 226 to the spray headers 232–236 which is commensurate with the advance rate of the aluminum strip 52. In a preferred embodiment, 5 cn. in. (12.7 cn. of solvent is used for 25,000 lbs. (11,353 kg) of sheet 52.

Figure 8:
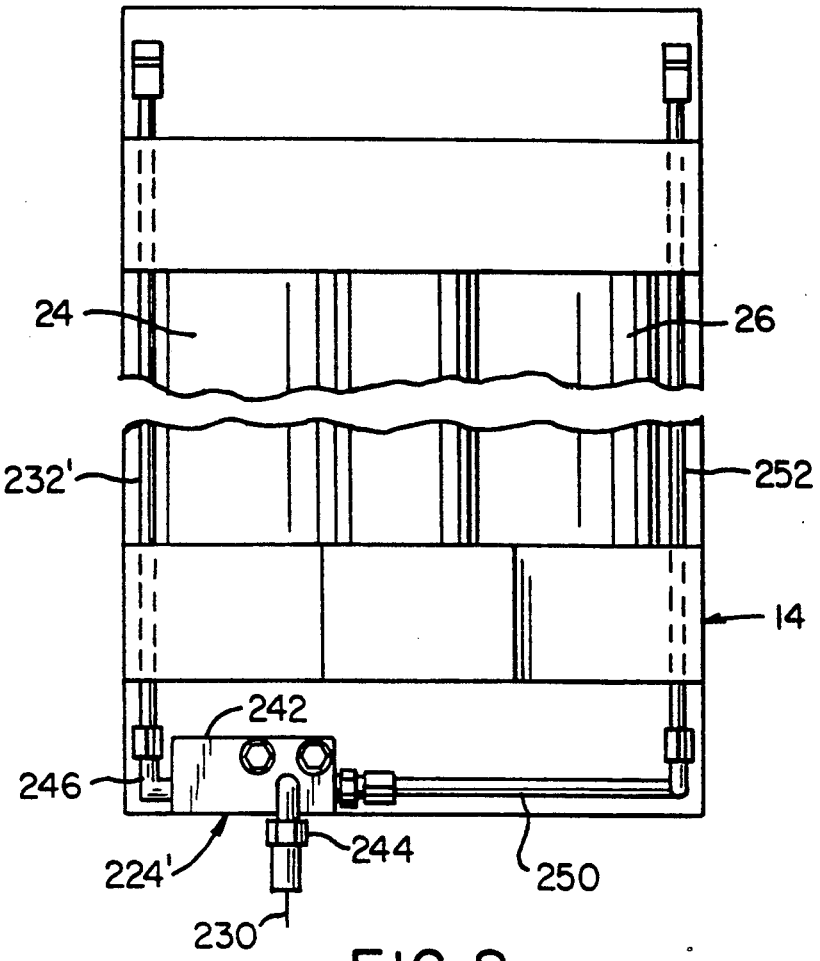
FIG. 8 is a top plan view of the embodiment of FIG. 7.
Figure 7:
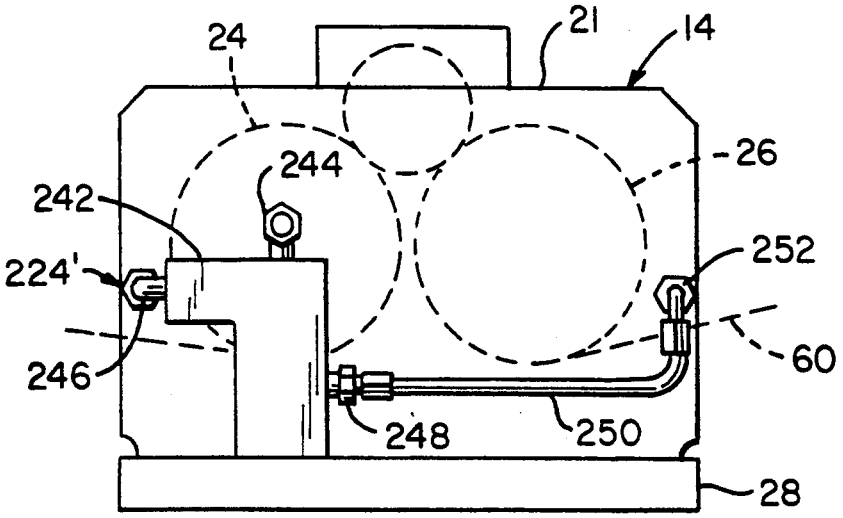
FIG. 7 is a schematic side elevation of the leveler of FIG. 1, showing an alternate embodiment of the invention.

An alternate embodiment of the solvent delivery system 224' is shown in FIGS. 7 and 8, with reference to lower work roll unit 14, which is shown schematically. Supply conduit 230 is connected to a distribution block 242 at a quick disconnect 244. Distribution block 242 includes a rearward port 246 which is connected to a rearward spray header 232' that extends the width of the backup roll 24. The distribution block 242 also includes a forward port 248 which is connected to a lateral conduit 250 which, in turn, is connected to an upstream or forward spray header 252, positioned immediately downstream of backup roll 26.

Spray headers 232' and 252 are also positioned immediately above the strip 60 of fabric material, both upstream and downstream of the lower work roll unit 14. By positioning a spray header immediately downstream of work roll unit 14, the strip 60 adjacent that point can be wetted and the capillary action occurring within the strip will convey the solvent solution forwardly to the backup roll 26. This provides additional solvent to that backup roll which may be lacking if the majority of solvent applied by spray header 232' is deposited on the backup roll 24. Although not shown, similar modifications can be made to upper work roll unit 18 and subsequent lower work roll units such as work roll unit 16.

While the forms of apparatus herein described constitute a preferred embodiment of this invention, it is to be understood that the present invention is not limited to these precise forms of apparatus and types of methods, and that changes may be made therein without departing from the scope of the invention.

What is claimed is:

1. For use in a tension leveler for metal strip of a type having a work roll and a backup roll supporting said work roll, a roll cleaning system comprising:

a strip of fabric media; and support means for holding said strip media in contact with said backup roll and conveying said strip media relative to said support means across said backup roll opposite of and out of contact with said work roll, whereby particles adhering to said backup roll are removed therefrom and transferred to said media.

2. The system of claim 1 wherein said support means includes pay out means for supporting an unused length of said media; and take up means for drawing said length past said backup roll.

3. The system of claim 2 wherein said take up means includes means for drawing said length past said backup roll continuously at a predetermined rate.

4. The system of claim 3 wherein said pay out means supports said length in a coiled form.

5. The system of claim 4 wherein said take up means collects said length in a coiled form.

6. The system of claim 5 wherein said drawing means includes motor means for rotating said collected length coil at a predetermined rate.

7. The system of claim 6 wherein said pay out means includes friction means for maintaining pay out of said unused length of said media at a rate approximately equal to a rate of collecting said length.

8. The system of claim 7 wherein said pay out means includes a pay out stand supporting a plurality of coils of said media, each of said coils being used to clean a different backup roll set of said associated leveler, and plate means pivotally attached to said pay out stand for facilitating mounting and removal of said coils.

9. The system of claim 1 further comprising means for delivering a solvent to said media prior to contact with said back up roll, whereby said solvent promotes release of said particles from said back up roll and transfer of said particles to said media.

10. The system of claim 9 wherein said solvent delivering means includes manifold means for spraying said solvent across a width of said media; valve means for controlling a flow rate of said solvent to said manifold means; and reservoir means for containing a supply of said solvent under pressure.

11. The system of claim 10 wherein said solvent delivering system includes conduit means for conveying said solvent from said reservoir means to said manifold means.

12. The system of claim 10 wherein said manifold means includes a first spray head positioned upstream of said backup roll; and a second spray head positioned downstream of said backup roll; said spray heads being oriented to spray solvent on said media upstream and downstream of said backup roll, respectively.

13. The system of claim 1 wherein said support means includes a pair of support plates positioned upstream and downstream of said back up roll on a side opposite said work roll, said support plates being shaped and positioned to urge said media to contact an arcuate portion of said back up roll.

14. The system of claim 13 wherein said tension leveler includes a pair of said back up rolls positioned to support said work roll in a nip therebetween; and said support means includes three of said support plates, a first and second being positioned upstream and downstream of said pair of back up rolls and a third being positioned adjacent a nip between said back up rolls opposite said work roll, whereby said media is urged into contact with arcuate portions of both of said back up rolls.

15. The system of claim 1 wherein said media is polyester filter cloth.

16. The system of claim 15 wherein said cloth is approximately 27 mils (0.686 mm) thick.

17. The system of claim 9 wherein said solvent is selected form the group consisting of: kerosene, petroleum hydrocarbon and petroleum naphtha.

18. The system of claim 11 wherein said solvent is delivered to said media at a rate of 5 cu. in. (12.7 cu. cm) for 25,000 lbs (11,363 kg) of metal strip passing over said work roll.

19. For use in a tension leveler of a type having a work roll for contacting a strip of metal to be leveled and a pair of back up rolls positioned to support said work roll in a nip formed between said back up rolls, said work and back up rolls being mounted on a carriage having end bearing plates separated by spacer plates oriented substantially parallel to aid back up rolls and being positioned at locations upstream and downstream of said back up rolls and adjacent a nip of said back up rolls, a roll cleaning system comprising:

a strip of filter cloth;

pay out means for supporting an unused portion of said cloth in a coil upstream of said work and back up rolls;

take up means for recoiling a used portion of said cloth, said take up means being positioned such that a length of said cloth extending from said pay out means to said take up means passes between said spacer plates and said back up rolls;

said spacer plates being positioned to urge said cloth against said back up rolls such that arcs of said back up rolls are swept by said cloth;

said take up means including motor means for coiling and uncoiling said cloth and guiding said cloth past said back up rolls at a predetermined rate;

means for delivering solvent to said cloth, said delivering means including a sprayer manifold including spray heads positioned to spray solvent evenly across a width of said cloth both upstream and downstream of said back up rolls, valve means for controlling a flow rate of said solvent to said manifold, and reservoir means for delivering solvent to said manifold under pressure; and means for controlling said valve means such that a rate of solvent delivery to said manifold is proportional to a rate of advancement of said cloth about said back up roll.

20. The system of claim 19 wherein said cloth is a filter cloth made of polyester.

21. The system of claim 19 wherein said solvent is selected from the group consisting of: kerosene, petroleum hydrocarbon, and petroleum naphtha.

22. In a tension leveler for leveling metal strip of a type having a work roll and backup roll supporting said work roll, a method of cleaning a work roll comprising the step of:

passing a strip of fabric media across a portion of said backup roll opposite of said work roll without contacting said work roll such that particulate material transferred to said backup roll is carried by said strip of fabric media away from said work roll.

23. The method of claim 22 further comprising the step of depositing a solvent on said backup roll, whereby said particulate material is released from said backup roll to said strip.

24. The method of claim 23 wherein said depositing step includes the step of depositing said solvent on said strip upstream of said backup roll such that said solvent is transferred from said strip to said backup roll when said strip contacts said roll.

25. The method of claim 23 wherein said depositing step includes the step of depositing said solvent on said strip downstream of said backup roll, whereby said solvent is conveyed by capillary action upstream toward said backup roll.

26. The method of claim 22 wherein said passing step includes drawing said strip in a generally upstream-to-downstream direction against an arcuate portion of said backup roll generally opposite said work roll.

27. The method of claim 25 wherein said leveler includes a pair of said backup rolls and said drawing step includes drawing said strip against arcuate portions of both of said backup rolls generally opposite said work roll.

28. The method of claim 22 wherein said passing step includes the step of drawing said strip incrementally past said backup roll.

29. The method of claim 22 wherein said passing step includes the step of uncoiling a strip of said media from a coil; passing said media across an arcuate portion of said backup roll; and recoiling said media into a coil of used media.

* * * * *